United States Patent [19]

Yoshida

[11] 3,980,846

[45] Sept. 14, 1976

[54] ELECTRIC CONTACT ACTUATING MECHANISM FOR AN AUTOMATIC DOOR

[75] Inventor: Kenji Yoshida, Tokyo, Japan

[73] Assignees: Jupiter Corporation; Shinmei Sangyo Co., Ltd.; Solic Co., Ltd., all of Tokyo, Japan

[22] Filed: Jan. 2, 1975

[21] Appl. No.: 538,001

[52] U.S. Cl. ..... 200/61.39

[51] Int. Cl.[2] ..... H01H 3/16

[58] Field of Search ..... 200/61.39, 61.41–61.44, 200/153 N; 47; 307/149; 335/205–207; 318/266, 282

[56] References Cited

UNITED STATES PATENTS

| | | | |
|---|---|---|---|
| 2,752,150 | 6/1956 | Richmond et al. | 200/61.39 UX |
| 2,928,914 | 3/1960 | Gruber | 335/207 |
| 3,168,165 | 2/1965 | Bagnasco | 200/61.43 X |
| 3,308,406 | 3/1967 | Barnhart | 200/61.39 X |
| 3,622,722 | 11/1971 | Jackson et al. | 200/61.39 |
| 3,686,507 | 8/1972 | Krutz et al. | 335/207 X |
| 3,694,664 | 9/1972 | Carli | 200/61.43 X |

*Primary Examiner*—James R. Scott
*Attorney, Agent, or Firm*—George B. Oujevolk

[57] ABSTRACT

An electric contact actuating mechanism for an automatic door comprising a rotary operator having a rotary shaft and interlocked with a door-driving device, a desired number of working arms fitted on the rotary shaft of the rotary operator so that they may be separately rotated relative to the rotary shaft when the rotational force applied thereto exceeds a predetermined value, working elements mounted on the respective working arms, responsive switch elements provided on a base member so that they may be actuated when the working elements approach thereto, and a stopper provided on the base member for stopping the rotation of the working arms; and thereby enabling the adjustment of its electric contact to complete by one shuttling operation of the door when installed.

1 Claim, 4 Drawing Figures

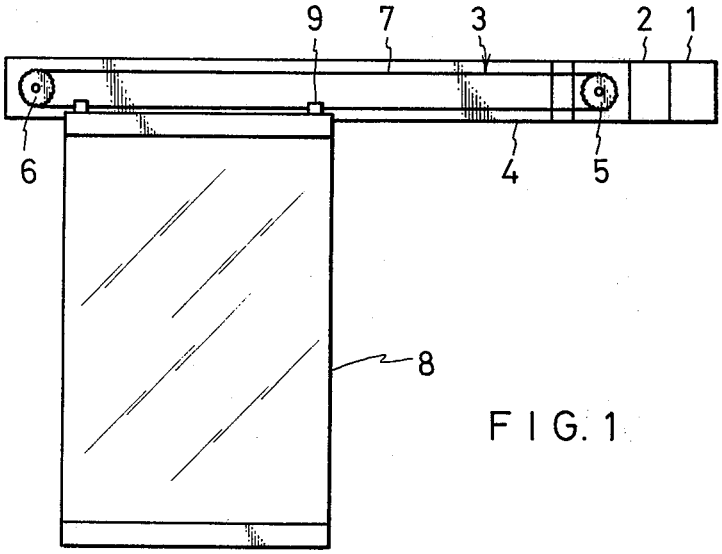
FIG. 1
FIG. 2
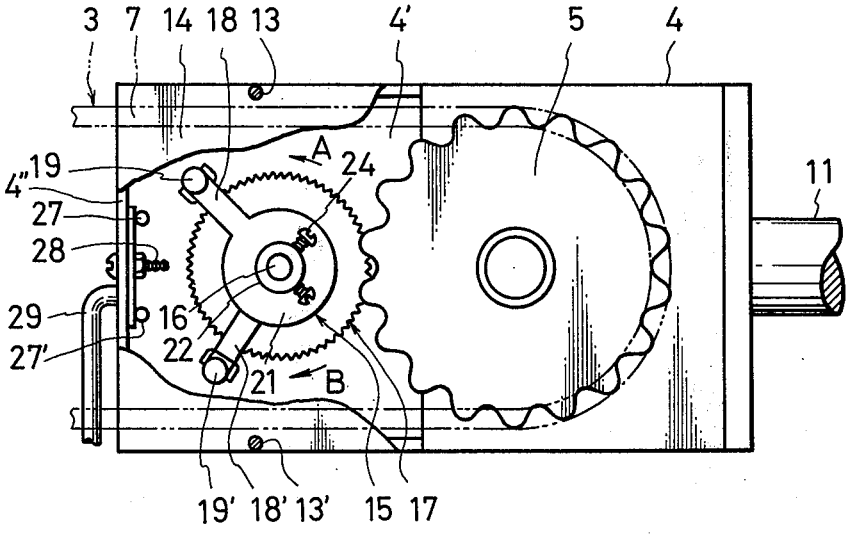

FIG. 3
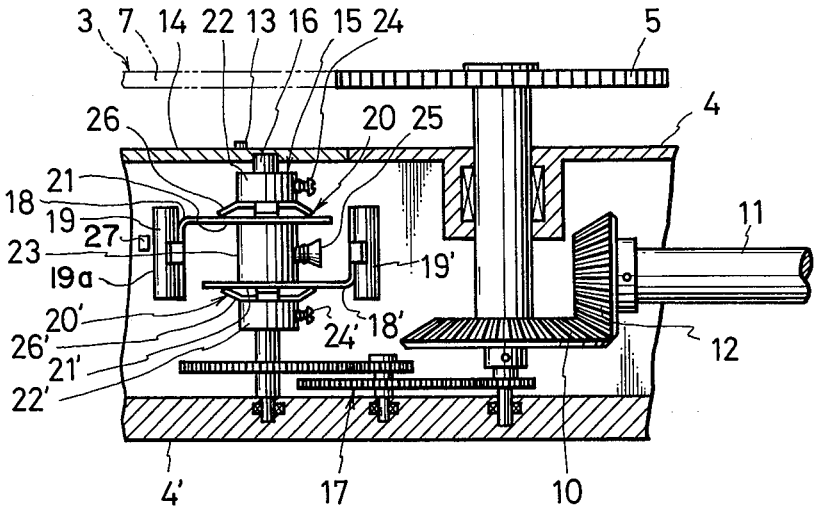
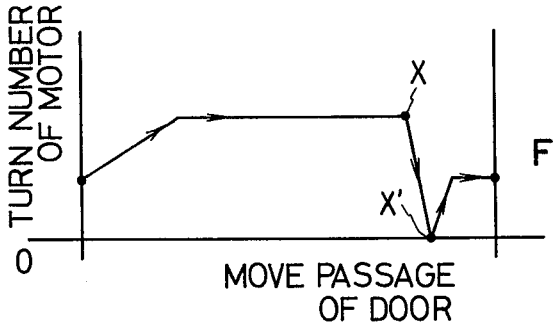
FIG. 4a
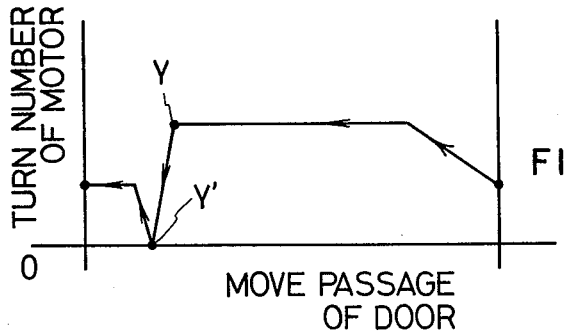
FIG. 4b

ELECTRIC CONTACT ACTUATING MECHANISM FOR AN AUTOMATIC DOOR

BACKGROUND OF THE INVENTION

1. Field of the Invention

This invention relates to an automatic door adapted to automatically open and close in response to the depression of a mat switch or the like and release of the depression thereof, and more particularly, to a mechanism suitable for generating operation commands so as to make and break an electrical contact, for instance, to temporarily stop an automatic door immediately before it is fully opened or fully closed, and thereafter slowly moving it again so that it may be fully opened or fully closed without abnormal shock noises, damage of glasses, etc.

2. Description of the Prior Art

Heretofore, various kinds of constructions have been proposed for such a mechanism for making and breaking an electric contact for an automatic door. However, all the conventional mechanism have disadvantages in that, in the installation operation of the automatic door, the electric contact thereof is very hard to adjust so that it may satisfactorily function at a predetermined time, and in addition, there are inconveniences that mounting-and-adjusting screws must be loosened and various parts must be displaced.

SUMMARY OF THE INVENTION

Accordingly, the present invention contemplates to eliminate the above-mentioned disadvantages and to provide a new and novel electric contact actuating mechanism for an automatic door.

It is therefore an object of the present invention to provide an electric contact actuating mechanism for an automatic door, in which the operating time of an electric contact thereof can be automatically adjusted by one shuttling operation of the automatic door.

It is another object of the present invention to provide an electric contact actuating mechanism for an automatic door, which can be installed with great efficiency and accuracy.

According to the present invention, there is provided an electric contact actuating mechanism comprising a motor, a door-driving device operated by the motor, a rotary operator interlocked with the door-driving device and having a rotary shaft, a base member for rotatably supporting the rotary shaft of the rotary operator, a desired number of working arms fitted on the rotary shaft of the rotary operator so that they may be separately rotated relative to the rotary shaft when the rotational force applied thereto exceeds a predetermined value, working elements mounted on said respective working arms, responsive switch elements corresponding to the respective working elements and provided on the base member so that they may be actuated when the respective working elements corresponding the switch elements approach thereto, and a stopper provided on the base member for stopping the rotation of the working arms.

BRIEF DESCRIPTION OF DRAWINGS

Other objects and advantages of the invention will be apparent from the following description taken in conjunction with the accompanying drawings, in which:

FIG. 1 is a schematic longitudinal elevational side view of an electric contact actuating mechanism for an automatic door according to the present invention;

FIG. 2 is a partially cutaway elevational side view of the essential portion of the mechanism shown in FIG. 1;

FIG. 3 is a sectional plan view of a part of the essential portion of the mechanism shown in FIG. 2, but viewed in a plane at right angles to the view shown in FIG. 2; and FIGS. 4*a* and 4*b* are is diagrams showing the relationship between the the door operation time elapsed and the motor speed.

DETAILED DESCRIPTION

Now the present invention will be hereinafter described with reference to the drawings. In FIG. 1, which shows an automatic door assembly according to the present invention, a motor 1 actuates a door-driving device 3 through a reduction gear 2. The door-driving device 3 is composed of a driving gear 5 and a driven gear 6 mounted on a base member 4 and, in addition, of an endless chain 7 engaging with the driving gear 5 and the driven gear 7. The endless chain is connected to a connection 9 of a door 8.

As shown in FIG. 3, a bevel gear 10 coaxial with the driving gear 5 is in mesh with a bevel gear 12 mounted on a driving shaft 11 of the reduction gear 2.

As shown in FIGS. 2 and 3, the base member 4 is composed of a base portion 4′ and a bearing cover-plate 14 fixed to the base portion 4′ by small screws 13 and 13′. Between the base portion 4′ and the bearing cover-plate, 14, a rotary shaft 16 of a rotary operator 15 is rotatably supported. In addition, a group of reduction gears 17 of the driving gear 5 is provided for transmitting the rotation of the driving gear 5 to the rotary shaft 16. L-shaped working arms 18 and 18′ are radially on the rotary shaft 16 so that they may be separately rotated relative to the rotary shaft 16 by a rotational force greater than a predetermined value. Any desired number of working arms may be provided, if suitable. As shown in FIG. 3, the working arms 18 and 18′ have a downward-extending portion and an upward-extending portion, respectively. These downward- and upward-extending portions are provided with cylindrical working elements 19 and 19′ made of magnet, iron piece, etc. fixed to the free ends thereof, so that the elements 19 and 19′ may be positioned at the same level. Elements 19, 19′ have buffer zones 19*a* to engage a stop member 28. Plate springs 20 and 20′ are fitted on the rotary shaft 16 so that the working arms 18 and 18′ may not be rotated unless they are subjected to a rotational force greater than a predetermined value. Side stop rings 22 and 22′ and a central stop ring 23 are fixed to the rotary shaft 16 by means of clamp screws 24, 24′ and 25, respectively. The plate spring 20 is positioned between the central stop ring 23 and the side stop ring 22 and urges the seat portion 21 of the working arm 18 to the stop ring 23 at all times through the resilient leg 26 thereof. The plate spring 20′ is positioned between the central stop ring 23 and the side stop ring 22′ and urges the seat portion 21′ of the working arm 18′ to the central stop ring 23 at all times through the resilient leg 26′ thereof.

As shown in FIG. 2, responsive switch elements 27 and 27′ in the form of reed switches or semi-conductive elements are provided on the side wall 4″ of the base member 4 so that they may be actuated when the working element 19 or 19′ approaches thereto. In addition, a stopper 28 is also provided on the side wall 4'' between the responsive switch elements 27 and 27'. The working elements 19 and 19' strike on the stopper 28 to stop. The reference numeral 29 designates a lead wire connected to the responsive switch elements 27 and 27'.

With the construction mentioned above, the mechanism according to the present invention can be installed as follows:

The base member 4 is installed at a predetermined position, and the door 8 is moved to be, for instance, fully closed as shown in FIG. 1. By the movement of the door 8, the driving gear 5 and the driven gear 6 are rotated through the endless chain 7, and thereby the rotary operator 15 is rotated in the direction of Arrow A (FIG. 2) through the reduction gear group 17. During the above rotation of the rotary operator 15, when the working element 19 strikes on the stopper 28, the working arm 18 comes to a standstill at that position, however, the rotary shaft 16 continues to rotate against the action of the plate spring 20 until the door is fully closed. Then, the door 8 is moved to be fully opened. By the opening movement of the door 8, the rotary shaft 16 is rotated in the direction of Arrow B (FIG. 2) together with the working arms 18 and 18', and thus the working element 19 is moved away from the stopper 28 and the other working element 19' approaches the responsive switch element 27'. If the working element 19' strikes the stopper 28 before the door 8 is fully opened, the working arm 18' will come to a standstill at that position while the rotary shaft 16 continues to rotate until the door 8 is fully opened. Thus, the working elements 19 and 19' can be located at predetermined positions in accordance with the opening and closing movement of the door 8. Therefore, if the distances between the stopper 28 and the responsive switch elements 27 and 27' are previously set at predetermined values, the responsive switch element 27 and 27' can be actuated by the working element 19 or 19' at a point in front of and at a predetermined short distance from the point where the working element 19 or 19' strikes on the stopper 28 to complete the opening or closing operation of the door 8.

By utilizing the above-mentioned operational properties of the responsive switch 27 and 27', the door 8 can be made to operate by the use of a suitable electric circuit as follows:

As shown graphically in FIGS. 4*a* and 4*b*, when the door 8 is being opened or closed the number of the motor turns can be considered as originating at the intersection of the ordinate and absicca axis of the graphs. These turns cause the door to travel the length designated as MOVE PASSAGE OF DOOR. When switch elements 27, 27' is enabled, the door is made to decelerate at point X or Y and to stop temporarily at point X' or Y', i.e., as the respective switch elements and stopper 28 determines. The door then continues its travel to the end of its run.

It will be understood from the foregoing description that the mechanism according to the present invention can automatically adjust the operating time of the electric contact relative to the door travel only by one shuttling operation of the door 8 and, as a result, can be installed efficiently and accurately without difficulty.

What is claimed is:

1. In an electrical contact actuating mechanism for an automatic sliding door, said mechanism having:

a. a base member (4) supporting a longitudinal door-driving device (3) including driving and driven gears (5,6) at opposed ends of said device (3), an endless chain (7) engaging said gears (5,6) with a connection (9) for driving a door (8), and motor drive means (1,2); and b. a rotary operator (15) interlocked with the door-driving device (3) having a rotary shaft (16) supported on said base member (4), the improvement therein comprising:

c. a predetermined number of radial working arms (18, 18') with outer ends mounted on said rotary shaft (16) so that said working arms are rotatable thereon, said outer ends traveling along a defined periphery, spring means (20) between said rotary shaft (16) and said working arms (18, 18') so that said working arms (18, 18') will only rotate separately when the rotational force applied thereto exceeds a predetermined value, adjusting means (22, 22', 23, 24, 25) to adjust the position of said working arms (18, 18'), switch enabling working elements (19, 19') held at said outer ends, said working elements including a contact buffer zone, switch elements (27, 27') corresponding to said switch enabling working elements (19, 19') mounted on said base member (4) disposed at predetermined locations near said defined periphery so as to be enabled as said switch enabling working elements (19, 19') pass before said switch elements, and, a stopper (28) on said base member (4) along said defined periphery at a predetermined location for stopping the rotation of said working arms (19, 19') so that the sliding movement of a door operated by said mechanism can be readily adjusted by adjusting the position of said working arms.

* * * * *